United States Patent [19]

Kohl

[11] Patent Number: 4,489,567

[45] Date of Patent: Dec. 25, 1984

[54] STACKABLE WATER PRESSURE EJECTION CONTROL ICE CUBE MAKER

[75] Inventor: Vance L. Kohl, Manitowoc, Wis.

[73] Assignee: The Manitowoc Company, Inc., Manitowoc, Wis.

[21] Appl. No.: 532,773

[22] Filed: Sep. 16, 1983

[51] Int. Cl.[3] ..... F25C 1/12; F25C 5/16

[52] U.S. Cl. ..... 62/138; 62/347

[58] Field of Search ..... 62/347, 348, 138, 353; 60/431

[56] References Cited

U.S. PATENT DOCUMENTS

| | | | |
|---|---|---|---|
| 3,306,072 | 2/1967 | Dahlgren et al. | 62/353 X |
| 3,362,182 | 1/1968 | Walker | 62/353 X |
| 3,367,127 | 2/1968 | Walker | 62/353 X |
| 4,341,087 | 7/1982 | Van Steenburgh, Jr. | 62/347 X |
| 4,366,679 | 1/1983 | Van Steenburgh, Jr. | 62/347 |

*Primary Examiner*—William E. Tapolcai

*Attorney, Agent, or Firm*—Leydig, Voit, Osann, Mayer & Holt, Ltd.

[57] ABSTRACT

An ice cube making machine having a vertical, open-faced freezing mold over which water is circulated from an underlying trough to build up ice. When the mold is full, the pump circulating the water is stopped and the ice is harvested. Harvesting is facilitated by a plunger that is biased to push ice from the mold. Water pressure from the pump holds the plunger against its bias until the pressure is released for the harvest cycle. The mold open face is covered by a water curtain having a lower lip underlying the mold open face so that the underlying trough need not extend substantially out from the mold, thereby permitting similar such units to be vertically stacked.

4 Claims, 2 Drawing Figures

STACKABLE WATER PRESSURE EJECTION CONTROL ICE CUBE MAKER

This invention relates generally to ice making machines and more particularly concerns such machines having vertical ice cube molds from which ice cubes must be harvested.

U.S. Pat. Nos. 3,430,452, issued Mar. 4, 1969, and 4,366,679, issued Jan. 4, 1983, disclose ice machines of the larger commercial variety which form ice cubes in a vertical freezing mold, in intimate contact with the evaporator coil of a refrigeration system, and having an open face divided into ice cube forming cells. To facilitate harvesting the formed cubes, an ejector can be energized to begin outward movement of the ice cube array, whereupon the array of cubes falls into a storage bin.

When forming the cubes, water is circulated across and into the open face of the mold, and water not frozen within the mold is collected in an underlying drain trough and recirculated. The trough is typically covered by a deflecting grid to prevent the harvested cube array from falling into the trough and directing the ice instead to the ice storage bin. To increase the ice making capacity of a given unit, mold assemblies can be stacked one on top of the other so that two or more are dumping ice into the same storage bin.

One aim of the invention is to provide an improved injector of the foregoing type which is reliable but economical since it does not depend on timing or control circuity. It is a related object of the invention to provide an ejector as characterized above that is activated when the water supply is stopped at the initiation of the harvest cycle, and which exerts a consistent uniform force to eject the cube array.

Another object of the invention is to provide an ice cube mold assembly as referred to above which is essentially flat faced so that two or more can be vertically stacked and ice will not be deflected a substantial distance away from the assemblies when it is harvested.

A further object is to provide an assembly with an ejector of the foregoing character that is particularly compact in the front-to-back dimension so as to conserve on cabinet space and give greater flexibility in the design of the total machine package.

Figure 1:
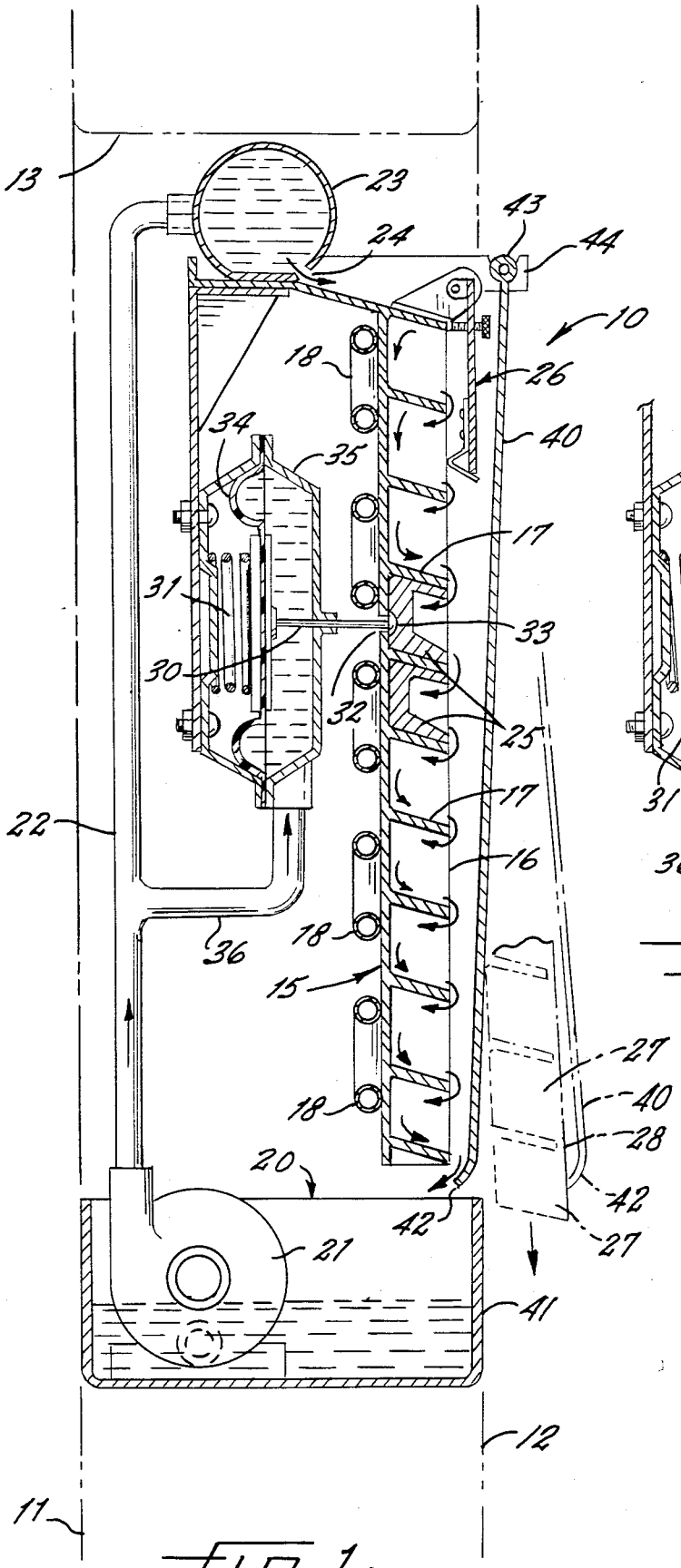
Figure 2:
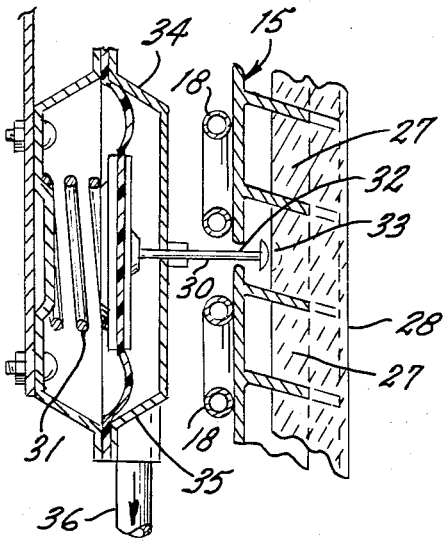

Other objects and advantges of the invention will become apparent upon reading the following detailed description and upon reference to the drawings, in which:

FIG. 1 is a vertical front-to-back cross section of an ice cube making machine embodying the present invention and showing water circulation, ice formation and the path and positioning of the ice cube array as it is ejected; and FIG. 2 is a fragmentary section of a portion of the structure shown in FIG. 1 with the ice ejecting plunger acting on the ice cube array.

While the invention will be described in connection with a preferred embodiment, it will be understood that we do not intend to limit the invention to that embodiment. On the contrary, we intend to cover all alternatives, modifications and equivalents as may be included within the spirit and scope of the invention as defined by the appended claims.

Turning to the drawing, there is shown an ice cube mold assembly 10 of an ice making machine fitting substantially within front and back surface lines 11 and 12.

Above the assembly 10 is an outline 13 suggesting how another similar assembly could be placed in stacked relationship to double the ice output.

The assembly 10 includes a substantially vertical mold 15 having an open outer face 16 divided into cube cells 17 and being intimately associated with the evaporator coils 18 of a conventional refrigeration system, not shown. An open topped drain trough 20 underlies the mold 15 and is kept filled with a supply of water under the control of a water level valve, not shown.

Water from the trough 20 is pressurized by a pump 21 and directed up a conduit pipe 22 extending from the trough to the top of the mold 15 where the water is fed into a fountain 23. The fountain 23 has a plurality of closely spaced lower openings 24 from which water flows at a controlled rate over the top of the mold, across the open face 16 and into the cells 17. During this ice making cycle, the coils 18 chill the mold 15 and ice cubes like the cubes 25 are built up.

The end of the ice making cycle is detected by a sensor probe 26 of the kind more fully described in U.S. patent application Ser. No. 461,122, filed Jan. 26, 1983, whereupon the ice making machine control circuit stops the ice making cycle and initiates the harvest cycle which includes stopping the pump 21 and directing hot gas through the coils 18. At this point, the ice is in the form of an array of cubes 27 held together by a relatively thin outer sheet of ice 28.

In accordance with the invention, a plunger 30 is mounted for movement into the mold 15 to push formed ice out, with the plunger being biased by a spring 31 to do the ejecting and with water pressure from the pump 21 overcoming the spring bias and controlling movement of the plunger. The plunger passes through a hole 32 in the rear wall of the mold 15 and is formed with a head 33 that closes the hole 32 during the ice making cycle. Water pressure is used to control the plunger 30 by connecting the plunger to a flexible diaphragm 34 mounted in a chamber 35 connected by a pipe 36 to the conduit 22. The spring 31 bears on the diaphragm 34.

While the pump 21 is running, water pressure on the diaphragm 34 holds the plunger 30 inoperative against the bias of the spring 31. When the pump is stopped at the initiation of the harvest cycle, water drains from the chamber 35 and the plunger 30, under spring bias, bears on the ice with a uniform pressure. As soon as the mold is somewhat heated by the coils 18 to release the cubes, the plunger helps push the ice array from the mold 15, whereupon it falls into an underlying ice storage bin, not shown, where the ice array typically breaks apart into individual cubes.

If it is desired to keep the pump running, the water pressure can be deactivated by opening the lower portion of the conduit 22 through a dump valve operated during the harvest cycle.

As a further feature of the invention, the face 16 of the mold is covered by a water curtain 40 that confines water splashing, the trough 20 has its forward wall 41 positioned so that it does not extend substantially out in front of the mold, and the curtain 40 is formed with a lower lip 42 extending under the mold open face 17 to the inner side of the trough front wall 41. Thus, water flowing over the mold face 16 is deflected by the lip 42 into the trough 20. The curtain 40 is preferably a rigid panel pivoted by a rod 43 and hooks 44 so as to swing out from the mold. When an array of ice is harvested, the curtain 40 swings out, as does the sensor probe 26, and the ice falls easily clear of the trough 20.

Since the outer face of the assembly 10 is substantially flat, duplicate ones of such assemblies can be stacked, as suggested by the outline 13, when greater ice production is desired, and with each assembly still feeding ice directly to a common ice storage bin.

It can now be appreciated that the plunger 30 needs no separate control circuit or expensive motor drive. The plunger is reliably driven by a spring and is simply controlled by the change of water pressure which inherently occurs when the machine goes from the ice making cycle to the harvest cycle. The pressure exerted by the plunger on the ice during the harvest cycle remains uniform while the ice is releasing in the mold that is being heated, and there is no attempt to mechnanically drive a plunger against a not yet loosened ice array.

Those skilled in the art will appreciate that the mechanism 10 has a short front-to-rear dimension, facilitated by using the flat chamber 35 to control the plunger 30, so that the assembly conserves outer cabinet space and permits considerable flexibility in the overall design of the ice machine package.

I claim as my invention:

1. An ice making machine comprising, in combination, a substantially vertical mold having an open outer face divided into cube cells and being intimately associated with refrigeration evaporator coils, an open top drain trough underlying said mold, means for pressurizing water in said trough and lifting the water to the top of said mold so that water will flow over said open face and into said cells, a plunger mounted for movement into said mold for pushing formed ice out of said open face, means for biasing said plunger in said ice pushing direction, and means for applying said pressurized water to overcome said bias and hold said plunger out of said mold, whereby deactivating said water pressurizing means will cause the plunger to urge ice from the mold.

2. The combination of claim 1 including means for detecting when said mold face is covered by ice so as to signal the deactivation of said water pressurizing means.

3. The combination of claim 1 in which said water pressurizing means includes a pump and a water conduit from said trough to the top of said mold, and said means for applying the pressurized water is a chamber connected to said conduit with a diaphragm in said chamber connected to said plunger.

4. The combination of claim 3 in which said means for biasing is a spring acting on said diaphragm.

* * * * *